US008056588B2

(12) United States Patent
Somerby

(10) Patent No.: US 8,056,588 B2
(45) Date of Patent: Nov. 15, 2011

(54) WATER FLAVOR DISPENSER

(76) Inventor: Kendall Bancroft Somerby, Paradise, CA (US)

( * ) Notice: Subject to any disclaimer, the term of this patent is extended or adjusted under 35 U.S.C. 154(b) by 1061 days.

(21) Appl. No.: 11/875,356

(22) Filed: Oct. 19, 2007

(65) Prior Publication Data

US 2008/0277019 A1 Nov. 13, 2008

Related U.S. Application Data

(60) Provisional application No. 60/917,667, filed on May 13, 2007.

(51) Int. Cl.
*B65B 1/04* (2006.01)

(52) U.S. Cl. ..... 141/105; 141/9; 141/104; 141/198; 141/351; 222/52; 222/129

(58) Field of Classification Search ..... 141/9, 100–105, 141/192, 198, 351; 222/52, 129–129.4
See application file for complete search history.

(56) References Cited

U.S. PATENT DOCUMENTS

| | | | | |
|---|---|---|---|---|
| 2,328,110 | A | 8/1943 | Thompson et al. | |
| 3,519,134 | A * | 7/1970 | Hassinger | 210/282 |
| 4,676,896 | A | 6/1987 | Norton | |
| 4,917,155 | A * | 4/1990 | Koblasz et al. | 141/1 |
| 5,114,048 | A * | 5/1992 | Minke | 222/135 |
| 5,151,179 | A | 9/1992 | Bach et al. | |
| 5,290,443 | A | 3/1994 | Norton | |
| 5,922,378 | A | 7/1999 | Kagan et al. | |
| 5,931,343 | A * | 8/1999 | Topar et al. | 222/56 |
| 6,227,265 | B1 * | 5/2001 | Skell et al. | 141/198 |
| D453,952 | S | 2/2002 | Gaston et al. | |
| 6,394,312 | B1 * | 5/2002 | Endou | 222/129.1 |
| 6,478,192 | B2 * | 11/2002 | Heyes | 222/144.5 |
| 6,513,337 | B1 * | 2/2003 | Astvatsatrian et al. | 62/66 |
| 6,672,097 | B1 * | 1/2004 | Ashley | 62/340 |
| 7,490,638 | B2 * | 2/2009 | Sher et al. | 141/100 |
| 2005/0145548 | A1 | 7/2005 | Rhoades | |
| 2005/0258082 | A1 | 11/2005 | Lund et al. | |

* cited by examiner

*Primary Examiner* — Timothy L Maust
(74) *Attorney, Agent, or Firm* — QuickPatents, Inc.; Kevin Prince

(57) ABSTRACT

A dispenser for dispensing a mixture of water and one of a plurality of concentrated formulas is disclosed. The dispenser comprises a housing that includes an electronic controller, a water inlet connected to a pressurized water source, and a water inlet valve that is electrically controlled and connected to the controller. A mixture reservoir is in fluid communication with the water inlet valve and a mixture outlet through which the mixture of water and one of the concentrate formulas exits the dispenser. A plurality of concentrate reservoirs each adapted to receive the concentrated formulas are each in fluid communication with the mixture reservoir. Each concentrate reservoir has a valve connected to the controller and capable of delivering a metered volume of the concentrated formula into the mixture reservoir when signaled by the controller. A selector knob is electrically connected to the controller and has at least one manually selectable position representative of each concentrate reservoir. A bypass valve may be included for bypassing the concentrate formulas, and a removable water filter may be included for filtering water passing through the device.

16 Claims, 3 Drawing Sheets

WATER FLAVOR DISPENSER

CROSS-REFERENCE TO RELATED APPLICATIONS

This application claims the benefit of U.S. Provisional Patent Application 60/917,667, filed on May 13, 2007.

STATEMENT REGARDING FEDERALLY SPONSORED RESEARCH AND DEVELOPMENT

Not Applicable.

FIELD OF THE INVENTION

This invention relates to dispensing, and more particularly to a faucet-mounted flavored water dispenser.

DISCUSSION OF RELATED ART

Water filter devices for use in the home and attached to faucets are well known in the art. Such devices typically provide water filtration in one mode, and a filter bypass in a second mode. Faucet-mounted products made by Brita, for example, are exemplary of such devices.

Soda dispensers are also known in the art, such dispensers typically having one mixing valve for each flavor of soda for mixing a syrup with a pressurized supply of carbonated water. Such dispensers are too large and bulky for use on a typical kitchen faucet, however.

As such, there is a need for a combination filter and flavored drink dispenser that can be used on a typical home kitchen faucet. US Patent Application 2005/0258082 to Lund et al. on Nov. 24, 2005, teaches such a device. However, such a device has the drawbacks that flavor additive is not adequately rinsed out of the device between uses. In the embodiment illustrated in FIG. 7, for example, multiple reservoirs for the additive are included, but additive remaining in each conduit (28) dispensed previously remains in such a common conduit and mixes undesirably with the next different additive that is selected and dispensed. Further, such a device does not make any provision for easily replacing flavors in each reservoir, nor does it provide for notification of empty reservoirs, expired additives, filter end-of-life, and automatic dispensing of a pre-selected volume of a mixed beverage. Further, such a device must be manually actuated each time it is used.

Therefore, there is a need for a dispensing device that not only provides for the user's selection of one of a plurality of flavors or beverage types, but that also prevents contamination of a previous flavor when dispensing an alternate flavor. Further, such a needed device would allow new flavors to be added easily, and would monitor the age of concentrated flavor formulas and the age of the filter, in order to indicate to the user when same have reached a predetermined age. Still further, such a needed device would allow the user to select a pre-set volume of mixed beverage, and then would detect when the user has placed a receptacle under the mixed beverage outlet to activate the dispenser and delivered the pre-set volume. The present invention accomplishes these objectives.

SUMMARY OF THE INVENTION

The present device is a dispenser for dispensing a mixture of water and one of a plurality of concentrated formulas. Such concentrated formulas may be tea extracts, fruit extracts, or the like, and are in liquid form. When mixed with water in the proper ratio, the result is a reconstituted beverage such as lemonade or tea, for example.

The dispenser comprises a housing that retains therein an electronic controller. A water inlet is connected to a pressurized water source and includes a water inlet valve that is electrically controlled and connected to the controller. A mixture reservoir is in fluid communication with the water inlet valve through a water conduit disposed within the housing. The mixture reservoir is further in fluid communication with a mixture outlet through which the mixture of water and one of the concentrate formulas exits the dispenser.

A flow meter is disposed within the water conduit and communicates to the controller a flow rate of water entering the water conduit. A plurality of concentrate reservoirs each adapted to receive the concentrated formulas are each in fluid communication with the mixture reservoir. Each concentrate reservoir has a concentrate reservoir valve connected to the controller and capable of delivering a metered volume of the concentrated formula into the mixture reservoir when signaled by the controller.

A first presence detector is disposed proximate the mixture outlet on the housing and is electrically connected to the controller. The first presence detector is capable of detecting the presence of an object, such as a drinking cup, proximate the mixture outlet.

A selector knob extends through the housing and is electrically connected to the controller. The selector knob has at least one manually selectable position representative of each concentrate reservoir. A display means may be fixed to the housing for indicating which of the plurality of concentrate reservoirs is selected by the selector knob.

In one embodiment of the invention, the dispenser further includes a bypass outlet that is in fluid communication with the water inlet through a bypass valve disposed at least partially within the housing. In such an embodiment, a second presence detector may be disposed proximate the bypass outlet of the housing and electrically connected to the controller.

A water filter may be included within the housing and disposed between and in fluid communication with the water inlet and the bypass valve, such that water flowing through the water inlet 3 is filtered before either exiting the bypass outlet or the mixture outlet.

In use, with the water inlet connected to the pressurized water source and each concentrate reservoir filled with one of the concentrated formulas, in response to the object being detected proximate the mixture outlet, the controller actuates the water inlet valve, determines the volume of water flowing into the water conduit, and actuates one of the concentrate reservoir valves associated with the position of the selector knob to create the mixture of a predetermined ratio of the concentrated formula and the water to be dispensed through the mixture outlet. Upon detection that the object has been removed, the water inlet valve is closed.

The present device not only provides for the user's selection of one of a plurality of flavors or beverage types, but also prevents contamination of a previous flavor when dispensing an alternate flavor. Further, the present invention allows concentrated formulas to be exchanged easily, and monitors the age of concentrated flavor formulas and the age of the filter, in order to indicate to the user when same have reached a predetermined age. Still further, the present device allows the user to select a pre-set volume of mixed beverage and actively detects when the user has placed a receptacle under the mixed beverage outlet to activate the dispenser and delivered the pre-set volume automatically, without the user needing to touch any part of the device other than the selector knob.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
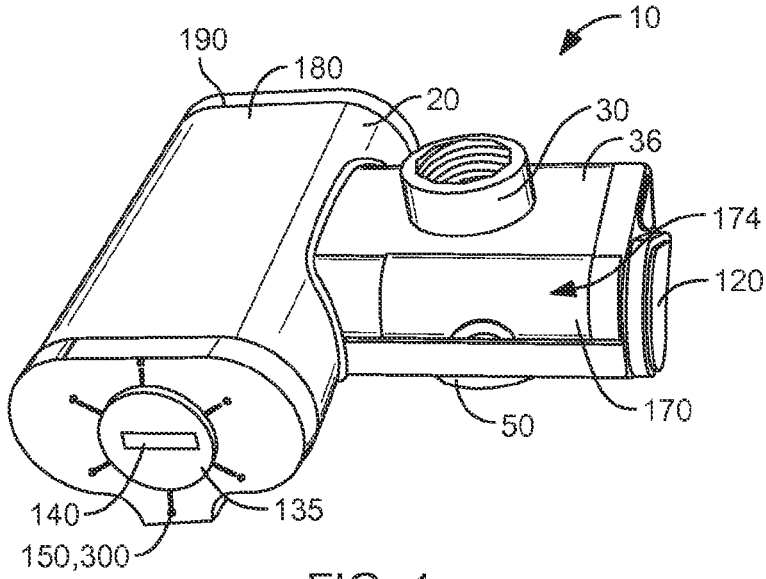
FIG. 1 is a perspective view of the invention.
Figure 2:
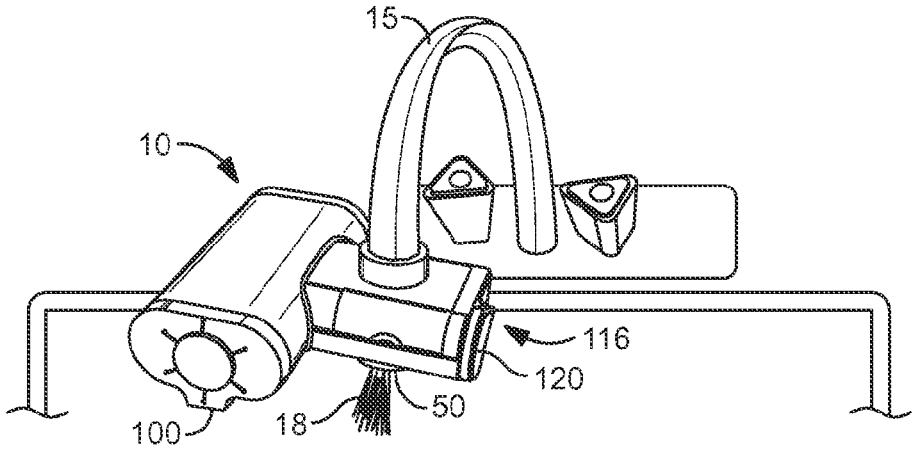
FIG. 2 is a perspective view of the invention, as attached to a kitchen faucet.
Figure 3:
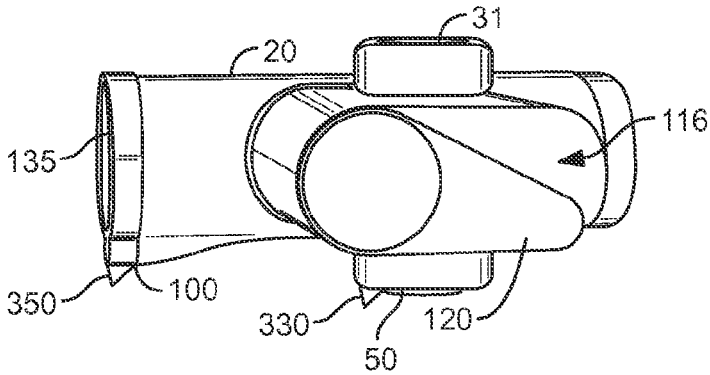
FIG. 3 is a perspective view of the invention, illustrating a bypass valve actuator thereof.
Figure 7:
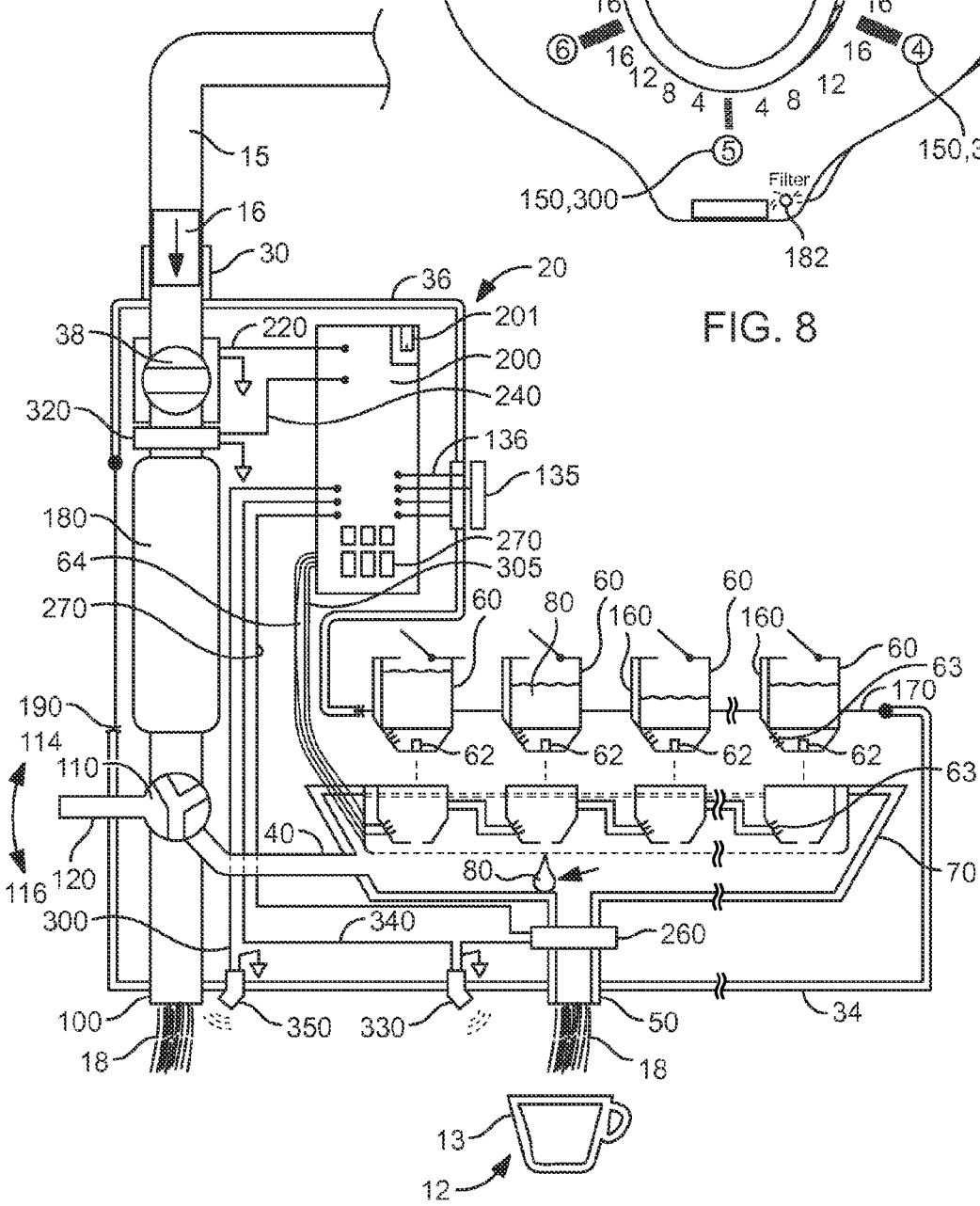
FIG. 7 is a diagrammatical view of the invention.

FIGS. 1, 2 and 7 illustrate a dispenser 10 for dispensing a mixture 18 of water 16 and one of a plurality of concentrated formulas 80. Such concentrated formulas 80 may be tea extracts, fruit extracts, or the like, and are in liquid form. When mixed with water 16 in the proper ratio, the result is a reconstituted beverage such as lemonade or tea, for example.

The dispenser 10 comprises a housing 20 that retains therein an electronic controller 200. The controller includes a power input 201, such as a battery, as is known in the art. The housing 20 is preferably a rigid plastic, but may also be made from stainless steel or other suitably rigid and durable material.

Figure 4:
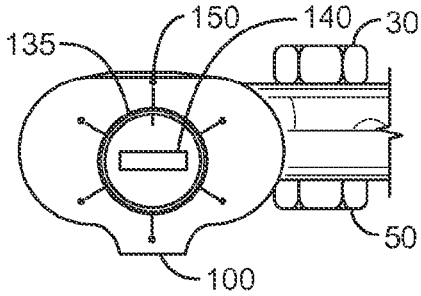
FIG. 4 is a front elevational view of the invention, illustrating a selector knob thereof.
Figure 5:
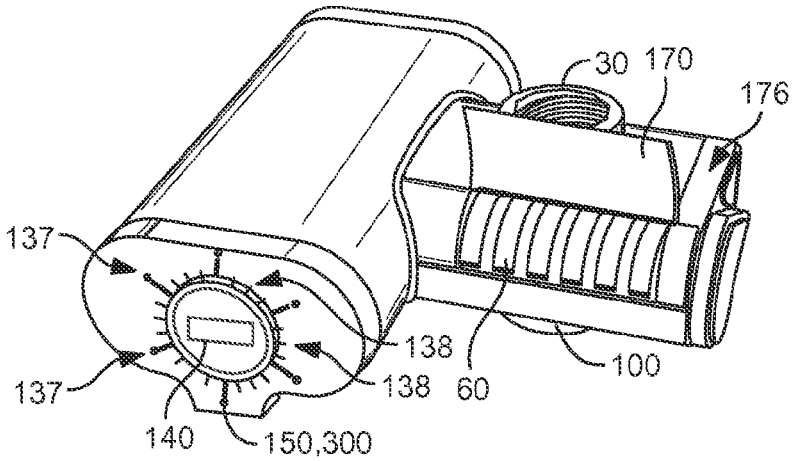
FIG. 5 is a perspective view of the invention, illustrating a plurality of concentrated formula reservoirs.

A water inlet 30 is connected to a pressurized water source 15, such as a standard water faucet left in an "on" position (FIG. 2). The water inlet 30 traverses an upper side 36 of the housing 20 and includes a water inlet valve 38 that is electrically controlled and connected to the controller 200 through a first electric signal line 220 (FIG. 7). The water inlet 30 may be a plastic threaded connector (FIG. 4), or other liquid conduit attaching device as is known in the art, such as a clamp or other means. Most faucets include a screw thread (not shown) for connecting to auxiliary devices, such as the dispenser 10 of the present invention.

A mixture reservoir 70 is in fluid communication with the water inlet valve 38 through a water conduit 40 disposed within the housing 20. The mixture reservoir 70 is further in fluid communication with a mixture outlet 50 traversing a lower side 34 of the housing 20, through which the mixture of water 16 and one of the concentrate formulas 80 exits the dispenser 10. Preferably the mixture reservoir 70 is made of plastic or other material that is easily cleaned and to which water 16 and the concentrated formulas 80 do not stick. The mixture reservoir 70 may further include a non-stick coating such as Teflon, or the like (not shown).

A flow meter 320 is disposed within the water conduit 40 and communicates to the controller 200 through a second electronic signal line 240 a flow rate of water 15 entering the water conduit 40. The pressurized water 16 drives the flow meter 320, which may be a small impeller or the like (not shown) connected to a sensor that detects and quantifies rotation. Such a flow meter is disclosed in US Patent Application 2006/0153165 to Beachy, published on Jul. 13, 2006, for example.

A plurality of concentrate reservoirs 60 each adapted to receive a volume V of one of the concentrated formulas 80 are each open to the upper side 36 of the housing 20 and are each in fluid communication with the mixture reservoir 70. Each concentrate reservoir 60 has a concentrate reservoir valve 62 connected to the controller 200 through a concentrate reservoir valve signal line 64 and capable of delivering a metered volume $V_i$ (where $V_i$<V) of the concentrated formula 80 into the mixture reservoir 70 when signaled by the controller 200 (FIG. 7). A typical volume for $V_i$ might be 1.5 ml of concentrated formula 80 for each 250 ml of water 16, for example, but could vary based on the type of concentrated formula 80 used or the user's taste preferences. A typical volume V of each concentrate reservoir 60 is 0.5 to 1 fluid ounce, for example. A compartment door 170 may be pivotally attached to the housing 20 that substantially covers each concentrate reservoir 60 in a closed position 174 (FIG. 1) and exposing same when in an open position 176 (FIG. 6).

A first presence detector 330, such as an infrared or ultrasonic detector, as are known in the art, is disposed proximate the mixture outlet 50 on the lower side 34 of the housing 20 and is electrically connected to the controller 200 through a third electronic signal line 340. The first presence detector 330 is capable of detecting the presence of an object 12, such as a receptacle 13, proximate the mixture outlet 50. Such a presence detector 330 may be a Sharp Model #GP2D12 or GP2D15 infrared sensor for use with faucets, for example.

Figure 8:
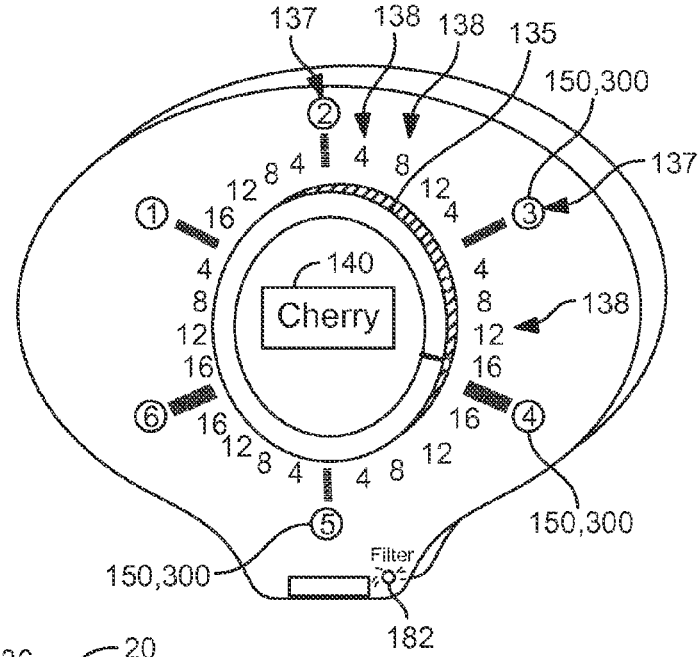
FIG. 8 is a front perspective view of the selector knob of the invention, further illustrating low-level indicators and a filter life indicator thereof.

A selector knob 135 extends through the housing 20 and is electrically connected to the controller 200 through a fourth signal line 136 (FIG. 8). The selector knob 135 has at least one manually selectable position 137 representative of each concentrate reservoir 60. A display means 140 may be fixed to the housing 20 for indicating which of the plurality of concentrate reservoirs 60 is selected by the selector knob 135. Such a display means may be a digital display, a mechanical flip-card display such as used with older digital clocks, or the like. Alternately, the selector knob 135 may be a plurality of push-buttons (not shown).

Figure 6:
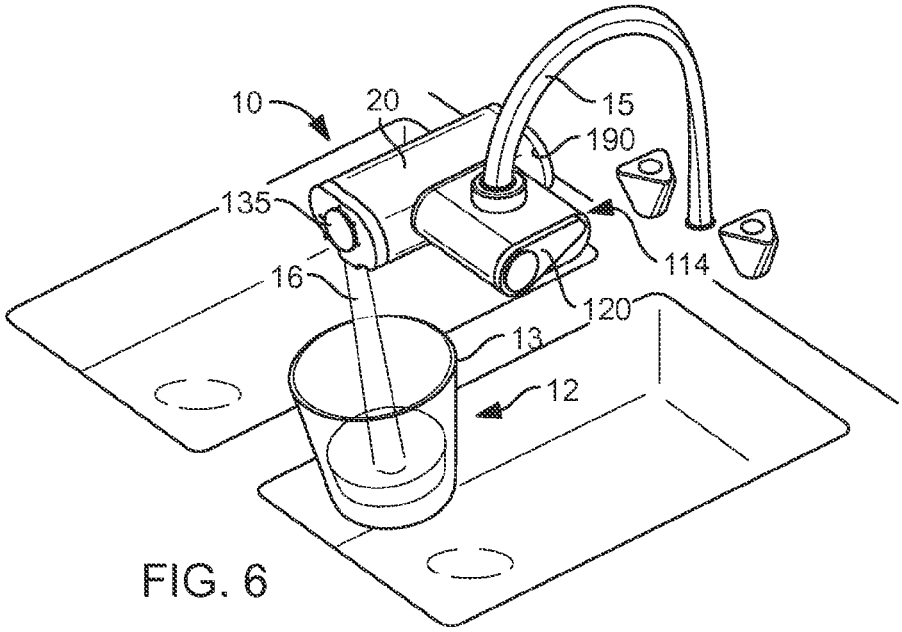
FIG. 6 is a perspective view of the invention, illustrating an object such as a drinking receptacle located under a bypass outlet of the invention.

In one embodiment of the invention, illustrated in FIG. 6, the dispenser 10 further includes a bypass outlet 100 that is in fluid communication with the water inlet 30 through a bypass valve 110 disposed at least partially within the housing 20. The bypass valve 110 includes an actuator 120 disposed outside of the housing 20. The bypass valve 100 is normally biased towards a bypass position 114 wherein water 16 is not mixed with any of the concentrated formulas 80 and exits the housing 20 at the bypass outlet 100. The bypass valve 110 further includes a concentrate position 116 wherein water 16 is directed into the mixing reservoir 70 to be mixed with one of the concentrated formulas 80 and then dispensed through the mixture outlet 50, as previously described.

In such an embodiment, a second presence detector 350 may be disposed proximate the bypass outlet 100 on the lower side 34 of the housing 20 and electrically connected to the controller 200 through a fifth electronic signal line 360. The second presence detector 350 is adapted to detect the presence of an object proximate the bypass outlet 100, whereby when the controller 200 detects an object 12 proximate the bypass outlet 100, the controller 200 may actuate the inlet valve 38, and upon detecting that the object 12 has moved away from the bypass outlet 100, the controller 200 may close the inlet valve 38.

A water filter 180 may be included within the housing 20 and disposed between and in fluid communication with the water inlet 30 and the bypass valve 110, such that water 16 flowing through the water inlet 30 is filtered before either exiting the bypass outlet 100 or the mixture outlet 50 (FIG. 7). Such a water filter 180 may be selectively interchangeable and removable through the housing 20, the housing including a filter aperture 190 through which the filter 180 may be passed (FIG. 1). A filter life indicator 182 may be included (FIG. 8) for indicating when a preset time has elapsed since the filter 180 was installed in the dispenser 10. Such a filter life indicator 182 is electronically connected to the controller 200 which activates the indicator 182, which may be an LED, for example, after a timing means (not shown) of the controller 200 expires. Such a timing means is reset when the water filter 180 is installed through the filter aperture 190, a momentary switch means being connected to the controller 200 to detect the installation of the new filter 180. Such a water filter 180 may include any suitable filter 180 as is known in the art, and may include a fabric or other filter membrane, activated charcoal, or the like.

In one embodiment of the invention, each concentrate reservoir 60 may be selectively removable from the housing 20, so as to be washed for example in a dishwasher (not shown). Alternately, each concentrate reservoir 60 may take the form of a cartridge (FIG. 7), that is refillable or, alternately, replaceable as with printer ink cartridges. In such an embodiment. In such an embodiment, each concentrate reservoir valve 62 remains closed when the concentrate reservoir 60 is disconnected from an electrical interface 63 between the mixing reservoir 70 and the concentrate reservoir 60. Each electrical interface 63, in such an embodiment, electrically connects the controller 200 to the concentrate reservoir valve 62 and, optionally, a plurality of low-level indicators 150 described in more detail below. Moreover, each electrical interface 63 may convey information from the concentrate reservoir 60 about its contents, such as its flavor, standard serving volume Vi, and the like, similar to printer ink cartridges on today's so-called "ink jet" type computer printers. Such content information may be conveyed through the controller 200 to the display means 140.

In use, with the water inlet 30 connected to the pressurized water source 15 and each concentrate reservoir 60 filled with one of the concentrated formulas 80, in response to the object 12 being detected proximate the mixture outlet 50, the controller 200 actuates the water inlet valve 38, determines the volume of water 16 flowing into the water conduit 40, and actuates one of the concentrate reservoir valves 62 associated with the position 137 of the selector knob 135 to create the mixture 18 of a predetermined ratio of the concentrated formula 80 and the water 16 to be dispensed through the mixture outlet 50. Upon detection that the object 12 has been removed, the water inlet valve 38 is closed.

In one embodiment, the selector knob 135 may further include a plurality of manually selectable preset volume positions 138 each associated with one of the concentrate reservoirs 60, such as "12 ounces," for example. As such, with the selector knob 135 at one of the manually selectable preset volume positions 138 corresponding to one of the concentrated formulas 80, when the controller 200 through the first presence detector 330 detects an object 12 proximate the mixture outlet 50, the controller 20 actuates the corresponding concentrate reservoir valve 62 to dispense the metered volume $V_i$ of the selected concentrate formula 80 into the mixing reservoir 70 and opens the inlet valve 38 until the preset volume of water 16 has entered the water conduit 40, as determined by the flow meter 320. The present volume of water 16 and the concentrated formula 80 mix in the mixing reservoir 70 and exit out of the mixture outlet 50. The controller 200 then closes the inlet valve 38 upon detecting that the preset volume of water 16 has entered the water conduit 40. Optionally, the controller 200 may then, for a period of time, open the inlet valve 38 to flush the mixture reservoir 70 and mixture outlet 50 with water 16 to rinse same.

Each low-level indicator 150 is visible from outside of the housing 20 and is optionally included on each concentrate reservoir 60 and adapted to indicate when the concentrate reservoir 60 is substantially empty, such as by a flashing or red or yellow LED located proximate each selectable position 137 of the selector knob 135 (FIG. 8). The low-level indicator 150 includes a concentrated formula level sensing means 160 and is optionally driven by the controller 200. Further, in such an embodiment, the controller 200 may include for each of the concentrate reservoirs 60 an expiration timer 290 that includes an expiration indicator 300 visible from outside of the housing 20 and adapted to indicate when the concentrated formula 80 in each concentrate reservoir 60 has reached a predetermined age since being introduced into the concentrate reservoir 60. The controller 200 resets the expiration timer 290 when an increase in the level of the concentrated formula 80 is sensed by the concentrate reservoir level sensing means 160, each concentrate reservoir level sensing means 160 being electrically connected in this case to the controller 200 through a level sensing means signal line 305 (FIG. 7). Such a level sensing means 160 may be float switches or other known level detectors, of the type sold by Deeter Electronics, Inc., of Canton, Ohio, for example.

In one embodiment of the invention, the mixture outlet 50 includes a content analyzer 260 in fluid communication therewith and adapted for sending a sensed particulate level signal of the mixture 18 of water 16 and the concentrated formula 80 to the controller 20 via a sixth electronic signal line 270 (FIG. 7). Such a content analyzer 260 counts discrete small objects suspended in the water 16, and is of the type made by Gam Rad, Inc. of Detroit, Mich., for example, their Gam Rad Fluid Analyser Model 260.

While a particular form of the invention has been illustrated and described, it will be apparent that various modifications can be made without departing from the spirit and scope of the invention. For example, various numbers and sizes of formula reservoirs 60 may be utilized. Accordingly, it is not intended that the invention be limited, except as by the appended claims.

What is claimed is:

1. A dispenser for dispensing a mixture of water and one of a plurality of concentrated formulas, comprising:

a housing;

an electronic controller disposed within the housing, the controller including a power input;

a water inlet connectable to a pressurized water source and traversing an upper side of the housing, the water inlet including a water inlet valve electrically connected to the controller through a first electric signal line;

a mixture reservoir in fluid communication with the water inlet through a water conduit disposed within the housing, the mixture reservoir in fluid communication with a mixture outlet traversing a lower side of the housing;

a flow meter disposed within the water conduit, the flow meter communicating a flow rate of water entering the water conduit to the controller through a second electronic signal line;

a plurality of concentrate reservoirs each openable to the upper side of the housing, each in fluid communication with the mixture reservoir, and each having a concentrate reservoir valve, each concentrate reservoir for receiving a volume of a concentrated formula and each concentrate reservoir valve electrically connected to the electronic controller through a concentrate reservoir valve signal line and capable of delivering a metered volume of the concentrated formula into the mixture reservoir when signaled by the controller;

a first presence detector disposed proximate the mixture outlet on the lower side of the housing and electrically connected to the controller through a third electronic signal line, the first presence detector capable of detecting the presence of an object proximate the mixture outlet;

a selector knob extending through the housing and electrically connected to the controller through a fourth signal line, the selector knob having at least one manually selectable position for each concentrate reservoir;

whereby in response to an object being detected proximate the mixture outlet, the controller can actuate the water inlet valve, determine the volume of water flowing into the water conduit, and actuate any of the concentrate reservoir valves to create a mixture of a predetermined ratio of the concentrate formula and water.

2. The water dispenser of claim 1 further including a bypass outlet in fluid communication with the water inlet through a bypass valve disposed at least partially within the housing, the bypass valve including an actuator disposed outside of the housing, the bypass valve biased towards a bypass position wherein water is not mixed with the concentrated formula and exits the housing at the bypass outlet, the bypass valve further having a concentrate position, wherein water is mixed in the mixing reservoir with the concentrated formula and then dispensed through the mixture outlet.

3. The water dispenser of claim 1 further including a display means fixed to the housing for indicating which of the plurality of concentrate reservoirs is selected by the selector knob.

4. The water dispenser of claim 2 further including a second presence detector disposed proximate the bypass outlet on the lower side of the housing and electrically connected to the controller through a fifth electronic signal line, the second presence detector capable of detecting the presence of an object proximate the bypass outlet, whereby when the controller through the second presence detector detects an object proximate the bypass outlet, the controller may actuate the inlet valve, and upon detecting that the object has moved away from the bypass outlet, the controller may close the inlet valve.

5. The water dispenser of claim 1 wherein the selector knob further includes a plurality of manually selectable preset volume positions each associated with one of the concentrate reservoirs, whereby with the selector knob at one of the manually selectable preset volume positions corresponding to one of the concentrated formulas, when the controller through the first presence detector detects an object proximate the mixture outlet, the controller actuates the corresponding concentrate reservoir valve to dispense a metered volume of the selected concentrate formula into the mixing reservoir and opens the inlet valve until the preset volume of water has entered the water conduit, as determined by the flow meter, the preset volume of water and the concentrated formula mixing in the mixing reservoir and exiting out of the mixture outlet, the controller closing the inlet valve upon detection that the preset volume of water has entered the water conduit.

6. The water dispenser of claim 1 wherein each of the concentrate reservoirs further includes a low-level indicator visible from outside of the housing and adapted to indicate when the concentrate reservoir is substantially empty, each low-level indicator including a concentrated formula level sensing means.

7. The water dispenser of claim 1 wherein a compartment door is pivotally attached to the housing, the compartment door substantially covering each concentrate reservoir in a closed position and exposing same when in an open position.

8. The water dispenser of claim 1 further including a water filter in fluid communication with and disposed between the water inlet and the mixture outlet.

9. The water dispenser of claim 2 further including a water filter in fluid communication with and disposed between the water inlet and the bypass valve.

10. The water dispenser of claim 8 wherein the water filter is selectively interchangeable and removable through the housing, the housing including a filter aperture through which the filter may be passed.

11. The water dispenser of claim 1 wherein the mixture output includes a content analyzer in fluid communication therewith and adapted for sending a sensed particulate level signal of the mixture of water and concentrated formula to the controller via a sixth electronic signal line, the controller adapted to control each concentrate reservoir valve in relation to the sensed particulate level.

12. The water dispenser of claim 6 wherein the controller further includes for each of the concentrate reservoirs an expiration timer, the expiration timer including an expiration indicator visible from outside of the housing and adapted to indicate when the concentrated formula in each concentrate reservoir has reached a predetermined age since being introduced into the concentrate reservoir, the controller resetting the expiration timer when an increase in the level of the concentrated formula is sensed by the concentrate reservoir level sensing means, each concentrate reservoir level sensing means being electrically connected to the controller through a level sensing means signal line.

13. The water dispenser of claim 1 wherein each concentrate reservoir is selectively removable from the housing, each concentrate reservoir valve of each concentrate reservoir remaining closed when disconnected from an electrical interface between the mixing reservoir and the concentrate reservoir.

14. A method of dispensing flavored water, comprising the steps of:

a) providing a dispenser as recited in claim 1;

b) instructing a user to connect the water inlet to the pressurized water source;

c) instructing the user to fill at least one of the concentrate reservoirs with one of the concentrated formulas;

d) instructing the user to place a receptacle below the mixture outlet;

e) causing the controller to, upon detection of the presence of the receptacle below the mixture outlet, actuate the water inlet valve and one of the concentrate reservoir valves to deliver water and the metered volume of the concentrated formula into the mixture reservoir to mix and dispense out from the mixture outlet;

f) causing the controller to, upon detection of the removal of the receptacle from below the mixture outlet, shutting the concentrate reservoir valve while allowing the water inlet valve to remain open for a predetermined period of time to flush the mixture reservoir and mixture outlet with water; and g) causing the controller to shut the water inlet valve.

15. A method of dispensing flavored water, comprising the steps of:

a) providing a dispenser as recited in claim 5;

b) instructing a user to connect the water inlet to the pressurized water source;

c) instructing the user to fill at least one of the concentrate reservoirs with one of the concentrated formulas;

d) instructing the user to select a preset volume with the selector knob e) instructing the user to place a receptacle below the mixture outlet;

f) causing the controller to, upon detection of the presence of the receptacle below the mixture outlet, actuate the water inlet valve and one of the concentrate reservoir valves to deliver the preset volume of water and the metered volume of the concentrated formula into the mixture reservoir to mix and dispense out from the mixture outlet; and g) causing the controller to shut the water inlet valve.

16. The method of dispensing flavored water of claim 15, further comprising the steps of:

h) causing the controller to, upon detection of the removal of the receptacle from below the mixture outlet, opening the water inlet valve for a predetermined period of time to flush the mixture reservoir and mixture outlet with water; and i) causing the controller to shut the water inlet valve.

* * * * *